US007090209B1

(12) United States Patent
Rowlay

(10) Patent No.: US 7,090,209 B1
(45) Date of Patent: Aug. 15, 2006

(54) ADJUSTABLE CLAMP AND METHOD OF USING AN ADJUSTABLE CLAMP

(75) Inventor: Stephen Rowlay, Sheffield (GB)

(73) Assignee: Stanley Tools and Hardware, New Britain, CT (US)

( * ) Notice: Subject to any disclaimer, the term of this patent is extended or adjusted under 35 U.S.C. 154(b) by 0 days.

(21) Appl. No.: 11/236,566

(22) Filed: Sep. 28, 2005

(51) Int. Cl.
*B25B 1/00* (2006.01)

(52) U.S. Cl. ..... 269/6; 269/3; 269/249

(58) Field of Classification Search ..... 269/6, 269/3, 166–170, 249, 246, 143; 81/487
See application file for complete search history.

(56) References Cited

U.S. PATENT DOCUMENTS

| | | | | |
|---|---|---|---|---|
| 4,220,322 | A | | 9/1980 | Hobday |
| 4,524,650 | A | | 6/1985 | Marks |
| 4,664,365 | A | | 5/1987 | Heine |
| 4,736,927 | A | | 4/1988 | Clancy |
| 4,738,438 | A | | 4/1988 | Horie et al. |
| 4,739,838 | A | | 4/1988 | Marks |
| 4,770,401 | A | * | 9/1988 | Donaldson ..... 269/249 |
| 4,926,722 | A | | 5/1990 | Sorensen et al. |
| 5,005,449 | A | | 4/1991 | Sorensen et al. |
| 5,009,134 | A | | 4/1991 | Sorensen et al. |
| 5,022,137 | A | | 6/1991 | Sorensen et al. |
| D320,919 | S | | 10/1991 | Sorensen |
| 5,094,131 | A | | 3/1992 | Sorensen et al. |
| 5,110,100 | A | | 5/1992 | Cotton |
| D328,846 | S | | 8/1992 | Sorensen et al. |
| 5,161,787 | A | | 11/1992 | Hobday |
| 5,170,682 | A | | 12/1992 | Sorensen et al. |
| 5,222,420 | A | | 6/1993 | Sorensen et al. |
| D340,851 | S | | 11/1993 | Sorensen |
| D341,069 | S | | 11/1993 | Sorensen |
| 5,265,854 | A | | 11/1993 | Whiteford |
| D357,165 | S | | 4/1995 | Sorensen et al. |
| 5,443,246 | A | | 8/1995 | Peterson |
| 5,584,458 | A | | 12/1996 | Rando |
| 5,593,147 | A | | 1/1997 | Read |
| 5,664,817 | A | | 9/1997 | Ballew et al. |
| 5,666,964 | A | | 9/1997 | Meilus |
| 5,853,168 | A | | 12/1998 | Drake |
| 5,988,616 | A | | 11/1999 | Fuller et al. |
| D417,377 | S | | 12/1999 | Blank et al. |
| 6,029,964 | A | | 2/2000 | Bohl |
| 6,050,559 | A | | 4/2000 | de Souza |

(Continued)

*Primary Examiner*—Lee D. Wilson
(74) *Attorney, Agent, or Firm*—Pillsbury Winthrop Shaw Pittman LLP

(57) ABSTRACT

A jaw for a bar clamp having a trigger pivoted to a handle at a position on the handle that is spaced from the bar. The trigger directly contacting a drive lever at a contact point, such that the contact point between the trigger and the drive lever changes along the length of the drive lever as the trigger pivots with respect to the handle such that when the contact point is remote from the bar the trigger provides high mechanical advantage to the drive lever, and when the contact point is closer to the bar the trigger provides low mechanical advantage to the drive lever. Also, a method of using a bar clamp, including positioning first and second moving jaws on opposite sides of a member to be clamped and activating a mechanical motor to move the bar and force the first moving jaw toward the second moving jaw until both the first and second moving jaws securely clamp the first member to be clamped between the first and second moving jaws.

11 Claims, 8 Drawing Sheets

U.S. PATENT DOCUMENTS 6,089,556 A 7/2000 Whiteford
6,254,073 B1 7/2001 Noniewicz et al.
6,302,386 B1 10/2001 Fuller et al.
6,338,475 B1 1/2002 Ping
6,340,154 B1 * 1/2002 Young ..... 269/246
6,347,791 B1 2/2002 Chervenak
6,367,787 B1 4/2002 Poole et al.
6,386,530 B1 5/2002 Marks
6,412,767 B1 7/2002 Beckmann et al.
6,438,854 B1 8/2002 Kott, Jr.
6,450,489 B1 9/2002 Wang
6,474,632 B1 11/2002 Liou
6,578,837 B1 6/2003 Blank et al.
6,585,243 B1 7/2003 Li
6,641,122 B1 11/2003 Roesch
6,648,314 B1 * 11/2003 Degen et al. ..... 269/6
6,648,315 B1 11/2003 Lee
6,655,670 B1 12/2003 Liou
6,676,120 B1 * 1/2004 Hallbeck et al. ..... 269/6
6,685,176 B1 2/2004 Wirth, Jr. et al.
D488,043 S 4/2004 Ben-Gigi
6,758,098 B1 7/2004 Nunnelee
D494,828 S 8/2004 Phillips
D500,238 S 12/2004 Varzino
6,883,795 B1 * 4/2005 McCormick et al. ..... 269/239
2003/0075850 A1 4/2003 Wirth, Jr. et al.
2003/0090048 A1 5/2003 Varzinoe et al.
2003/0141644 A1 7/2003 Thomas
2004/0113344 A1 6/2004 Wirth, Jr. et al.
2004/0140602 A1 7/2004 Gerritsen et al.
2004/0195746 A1 10/2004 Marks

* cited by examiner

ADJUSTABLE CLAMP AND METHOD OF USING AN ADJUSTABLE CLAMP

FIELD OF THE INVENTION

The present invention relates to an adjustable clamp and to a method of using an adjustable clamp. More specifically, the present application illustrates embodiments of the present invention, including those relating to an adjustable clamp with a fixed jaw, and to an adjustable clamp with two moving jaws.

BACKGROUND

Known adjustable clamps include one moving jaw and one fixed jaw. U.S. Pat. No. 6,386,530 to Marks, U.S. Pat. No. 6,474,632 to Liou, U.S. Pat. No. 5,005,449 to Sorensen, U.S. Pat. No. 5,443,246 to Peterson, U.S. Pat. No. 5,265,854 to Whiteford, U.S. Pat. No. 5,853,168 to Drake, and U.S. Pat. No. 5,666,964 to Meilus, and U.S. Patent Application Publication Nos. 2003/0090048 to Verzino et al.; and 2004/0140602 to Gerritsen et al., which disclose various clamps, are each incorporated herein in its entirety by reference thereto, respectively.

SUMMARY OF THE INVENTION

One aspect of the invention relates to a fixed jaw for a bar clamp, comprising: a main section structured and arranged to permit a bar to pass-through; a clamping face extending from the main section; a drive lever positioned within the main section that is structured and arranged to directly couple the bar; a handle extending from the main section; and a trigger pivoted to the handle at a position on the handle that is the furthestmost position on the handle from the main section, the trigger directly contacting the drive lever at a contact point, such that the contact point between the trigger and the drive lever changes along the length of the drive lever as the trigger pivots with respect to the handle such that when the contact point is remote from the bar the trigger provides high mechanical advantage to the drive lever, and when the contact point is closer to the bar the trigger provides low mechanical advantage to the drive lever.

Another aspect of the invention relates to a bar clamp, comprising: a bar; a moving jaw coupled to the bar; and a fixed jaw having a main section structured and arranged to permit the bar to pass-through, a clamping face extending from the main section, a drive lever positioned within the main section that is structured and arranged to directly couple the bar, a handle extending from the main section, and a trigger pivoted to the handle at a position on the handle that is the furthestmost position on the handle from the bar, the trigger directly contacting the drive lever at a contact point, such that the contact point between the trigger and the drive lever changes along the length of the drive lever as the trigger pivots with respect to the handle such that when the contact point is remote from the bar the trigger provides high mechanical advantage to the drive lever, and when the contact point is closer to the bar the trigger provides low mechanical advantage to the drive lever.

Another aspect of the invention relates to a method of using a bar clamp, comprising: positioning first and second moving jaws on a first bar clamp, each of the moving jaws being selectively securable on a first bar; positioning a motor unit on the first bar; positioning the first and second moving jaws of the first bar clamp on opposite sides of a first member to be clamped; and activating the motor unit to move the first bar through the motor unit and force the first moving jaw toward the second moving jaw until both the first and second moving jaws securely clamp the first member to be clamped between the first and second moving jaws.

Still another aspect of the invention relates to a method of using a bar clamp, comprising: positioning a moving jaw on a first bar clamp, the moving jaw being selectively securable on the first bar; positioning a fixed jaw with a motor unit on the first bar, the fixed jaw having a main section structured and arranged to permit the first bar to pass-through, a clamping face extending from the main section, a drive lever positioned within the main section that is structured and arranged to directly couple the first bar, a handle extending from the main section, and a trigger pivoted to the handle at a position on the handle that is the furthestmost position on the handle from the first bar; and activating the motor unit to move the first bar through the fixed jaw and to force the moving jaw toward the fixed jaw, the activating of the motor unit occurring by pulling a trigger towards the handle as the trigger pivots at the furthestmost position on the handle from the first bar, the trigger directly contacting the drive lever at a movable contact point while the trigger is pulled, such that the contact point between the trigger and the drive lever changes along the length of the drive lever as the trigger pivots with respect to the handle so that when the pulling of the trigger begins and the trigger is at a position furthest from the handle, the contact point is remote from the first bar and the trigger provides a high mechanical advantage to the drive lever, and as the pulling of the trigger continues and the trigger is pulled closer to the housing the contact point moves along the length of the drive lever to a point that is closer to the first bar so that the trigger provides a lower mechanical advantage and moves the bar through the fixed jaw at a greater rate than when the contact point is furthest from the first bar.

Other aspects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DESCRIPTION OF ILLUSTRATED EMBODIMENTS

Figure 1:
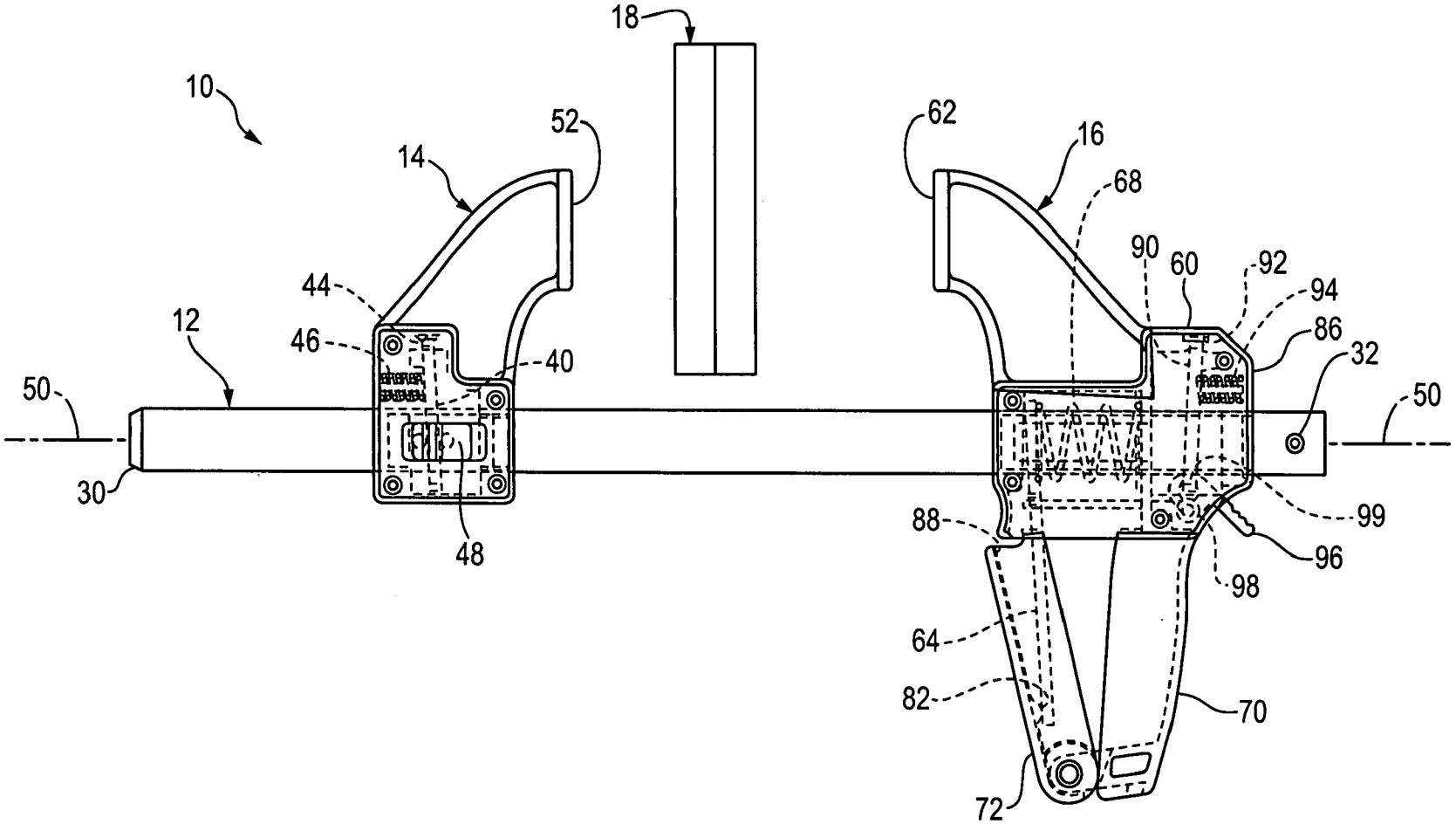
FIG. 1 illustrates a side view of an adjustable clamp, in accordance with one illustrated embodiment of the present invention.

One embodiment of the invention is illustrated in FIGS. 1–5, which illustrate an adjustable clamp 10 having a bar 12, a moving jaw 14, and a fixed jaw 16. In one embodiment, clamp 10 may be used by positioning jaws 14 and 16 on opposite sides of a member 18 to be clamped. The fixed jaw 16 is then activated to pull the bar 12 through the fixed jaw 16, thus bringing moving jaw 14 closer to fixed jaw 16. The fixed jaw 16 may be selectively activated so that the fixed jaw may move the bar 12 rapidly and easily through the fixed jaw 16 prior to the clamping of the member 18 and then, once the clamping on member 18 beings, the activation of fixed jaw 16 may advance the bar 12 through the fixed jaw 16 at a slower rate but with a higher mechanical advantage so that greater force can be applied in the easiest manner for the user applying the pressure to the fixed jaw 16 by hand.

Bar 12 is preferably a solid bar formed of sufficiently rigid material, such as metal or plastic. The bar 12 may have an inserting end 30 and a stop 32 to permit the jaws 14 and 16 to be inserted on the bar and removed from the same end, that is, via the inserting end 30. Alternatively, as discussed with other embodiments, the bar 12 may be formed without a stop 32 and the jaws 14 and 16 may be placed on and taken off the bar 12 at either end.

Although the moving jaw 14 may be any of the various moving-type jaws known in the prior art, moving jaw 14 is illustrated as having a braking lever 40 that permits the bar 12 to pass through moving jaw housing 42. The braking lever 40 is pivoted within the moving jaw housing 42 within a groove 44 and is biased by a resilient element, such as a spring 46. The spring 46 biases the braking lever 40 against the bar 12 to lock the housing 42 and the moving jaw 14 in a selected position on the bar 12. When it is desired to move the moving jaw 14 along the bar 12, a slide release button 48 is slid along a track to move the braking lever 40 from an inclined orientation with respect to the longitudinal axis 50 of the bar 12 to a more perpendicular orientation with respect to the longitudinal axis 50 of bar 12, thus freeing the braking lever 40 from the bar 12 and permitting the moving jaw 14 to move along the bar 12. Preferably, the moving jaw 14 would be moved to a selected position on the bar 12 and then clamped against member 18 upon activation of the fixed jaw 16. The moving jaw has an clamping face 52 for engaging member 18.

Member 18 is any member or members needed clamping. For example, member 18 may be two elements that are being joined together by adhesive and require a clamping force to ensure a tight connection while the adhesive cures.

Fixed jaw 16, as illustrated in the figures, has a main section that is structured and arranged to permit the bar 12 to pass there-through. As illustrated, the main section comprises a housing 60 having an opening extending completely therethrough for the passage of bar 12. The fixed jaw 16 also has a clamping face 62 extending from said housing 60. A drive lever 64 is positioned within the housing 60 and is structured and arranged to couple the bar 12. That is, the illustrated drive lever 64 has an opening 66 extending therethrough for the passage of bar 12. The drive lever 64 is movable within the housing 60 and may be maintained within its area of movement within the housing 60 by housing 60 itself. Drive lever 64 is biased by a resilient element, such as a spring 68 in a direction away from handle 70, which extends from housing 60 for grasping by a user. The handle has a lug 71 to which a trigger 72 is pivoted to the handle 70. The trigger 72 may pivot about a pin 74 extending through lug 71. The trigger 72 pivots at a position on the handle 70 that is the furthestmost position on the handle 70 from the bar 12. As illustrated in the figures, trigger 72 is pivoted to the bottommost section of the handle 70. The upper section 76 of the trigger 72 is free to move within the housing 60 and is maintained by the outer limits of housing 60 from pivoting outside the housing 60.

The trigger 72 is hollow with three sides and trigger 72 is open in the side facing handle 70. The inner contact surface 80 is the interior side of the trigger 72 that is most remote from the handle 70 and adjacent to the drive lever 64. The inner contact surface 80 provides the points of contact of the trigger 72 with the drive lever 64. As evident herein, as the trigger 72 is pulled toward the handle 70 the contact point with the drive lever changes position.

Figure 2:
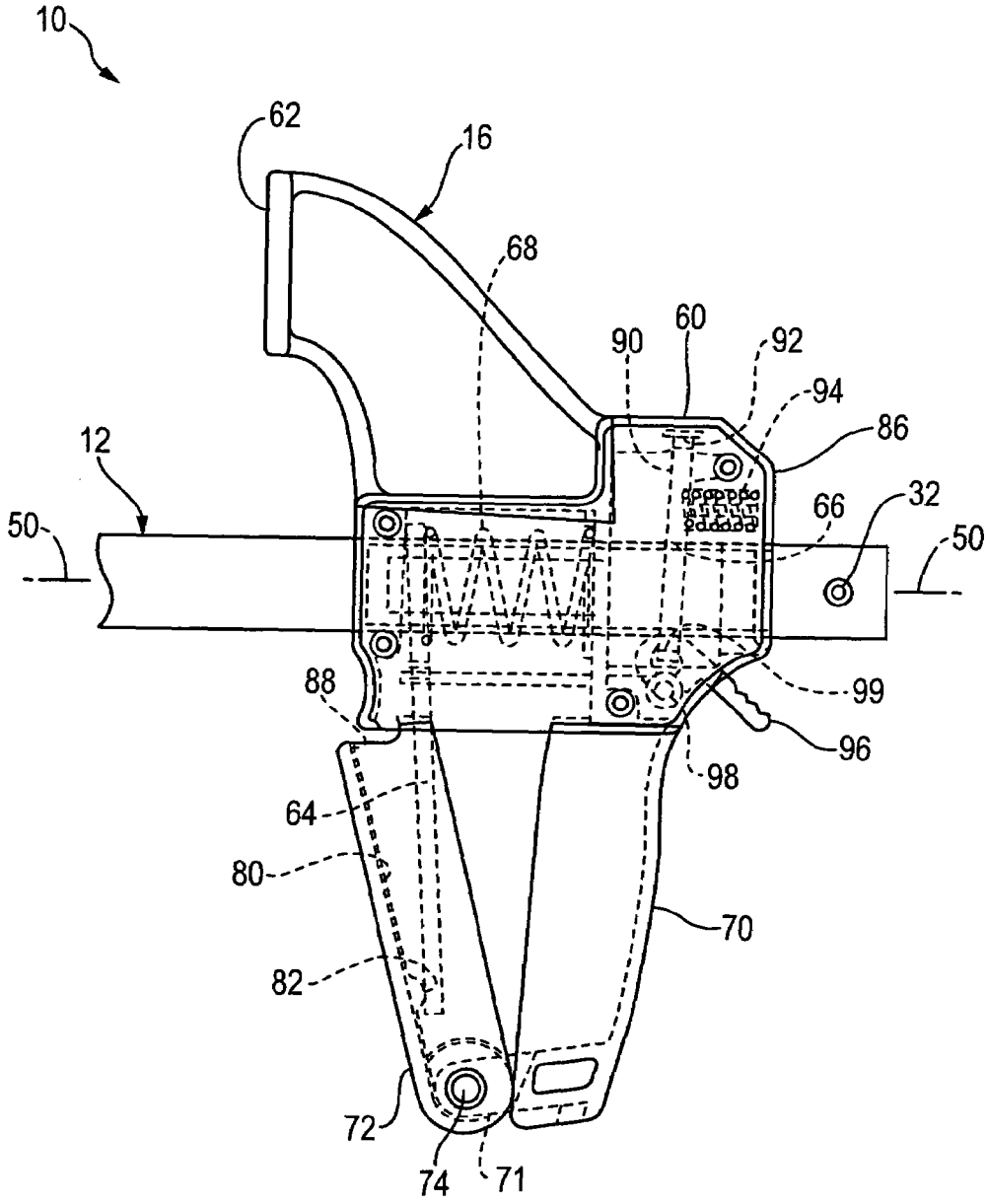
FIG. 2 illustrates an enlarged, side view of the fixed jaw of the clamp of FIG. 1.
Figure 3:
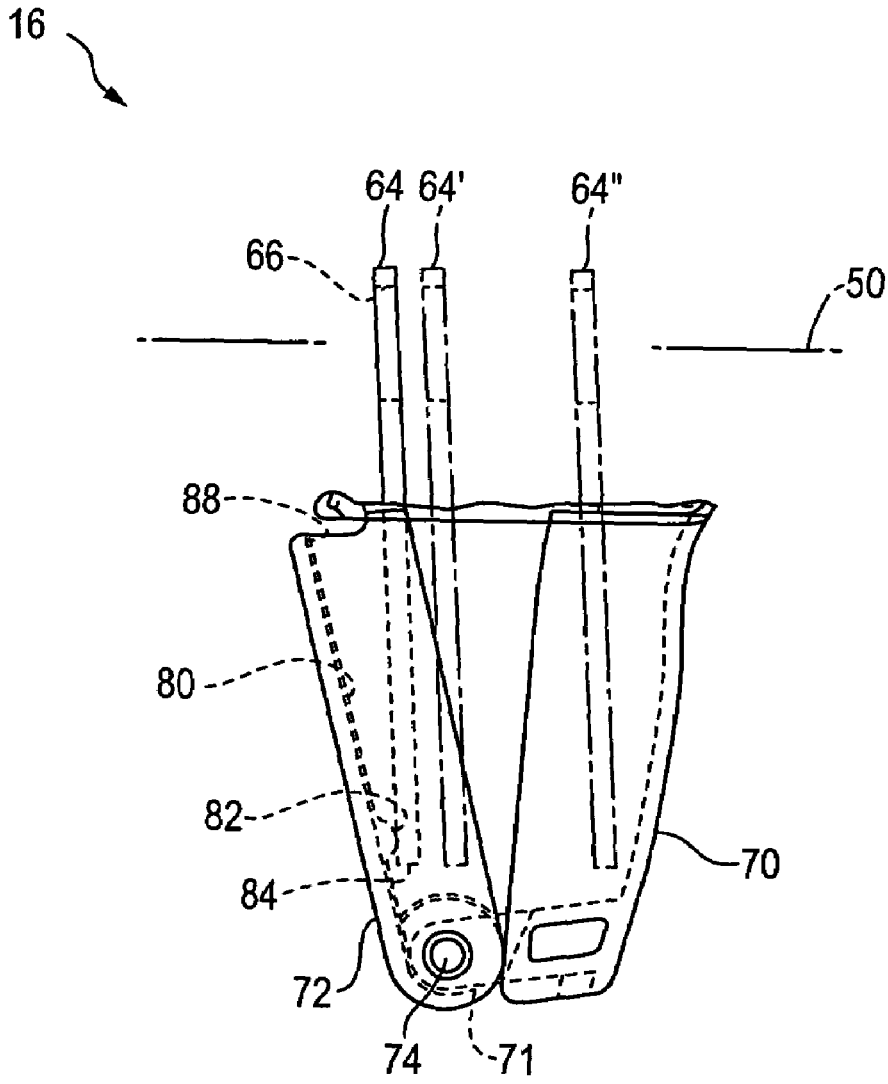
FIGS. 3–5 illustrate partial, views of the fixed jaw illustrated in FIG. 2 but showing the trigger and the drive lever in different positions with respect to the handle during activation of the trigger.

The trigger is shown in the nonactuated position in FIGS. 1–3. When the trigger 72 is in the nonactuated position, the trigger 72 is biased to pivot away from the handle 70 by the force of the drive lever 64 via the biasing of spring 68. In this nonactuated position, the trigger 72 has an initial contact point 82 on the contact surface 80 that is in contact with the drive lever 64. The initial contact point 82 may be in the form of a projection 82, as illustrated.

FIGS. 2–5 illustrate the pivoting of trigger 72 and the changing of the contact point between the trigger 72 and the drive lever 64. In FIGS. 2 and 3, the trigger 72 is in the nonactuated position as biased by spring 68. The trigger 72 contacts the driving lever 64 at initial contact point 82, which is at the remote end 84 of drive lever 64, which is the furthest extent of the drive lever 64 from the bar 12. As seen in the figures, the contact point 82 is at the bottom of the drive lever 64. Therefore, when the trigger 72 initially is pulled by a hand of the user and pivots about pin 74 toward the handle 70 out of the nonactuated position, the contact point 84 with the drive lever 64 is such that a high mechanical advantage is produced for forcing the drive lever 64 to move the bar 12 toward the rear end 86 of housing 60. This is because the force applied by the user on the trigger 72 is directed against the drive lever 64 at the furthest point on the drive lever 64 from the connection between the drive lever 64 and bar 12. Since the size of the opening 66 in drive lever 64 is slightly larger than the width of the bar 12, when the angle of bar 12 is inclined with respect to a line parallel to the longitudinal axis 50 of the bar 12, as shown in FIGS. 1–5, a tight, slip-free fit is created between the bar 12 and the drive lever 64 so that when the drive lever 64 is moved, the bar 12 moves along with the drive lever 64.

Figure 4:
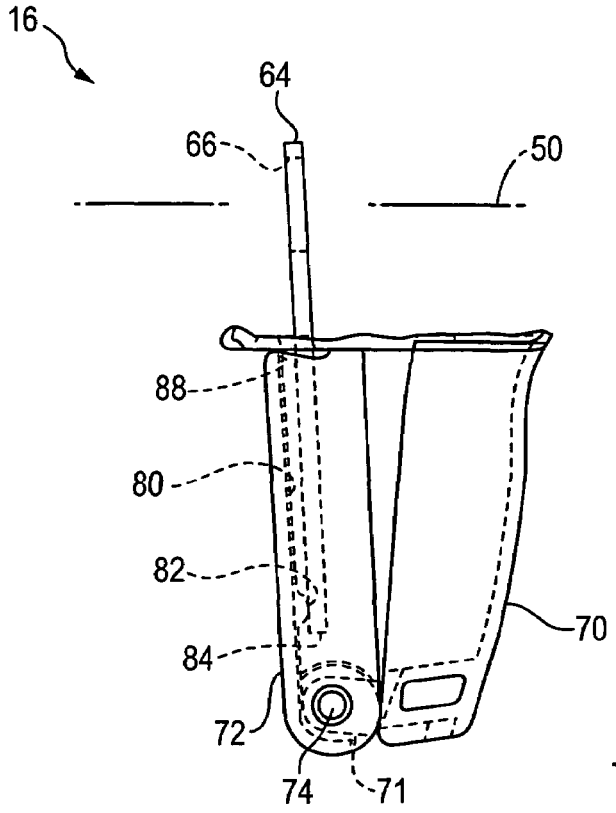

As seen in FIG. 4, as the trigger 72 is pivoted toward handle 70, the contact point 84 between the trigger 72 and the drive lever 64 does not necessarily change, but the pivoting of the handle 70 moves the protrusion that forms the contact point 84 closer toward the handle 70 and, thus, forces movement to the drive lever 64 toward the rear 86 of housing 60 while continuing to provide a high mechanical advantage since the contact point between the trigger 72 and the drive lever 64 remains at the remote end 84 of the drive lever 64. FIG. 3 shows the positional movement change of the drive lever 64 from the nonactuated position of FIG. 2 (shown with drive lever 64 in solid lines) to the position of FIG. 4 (shown with the drive lever 64' (primed) in dashed lines).

Figure 5:
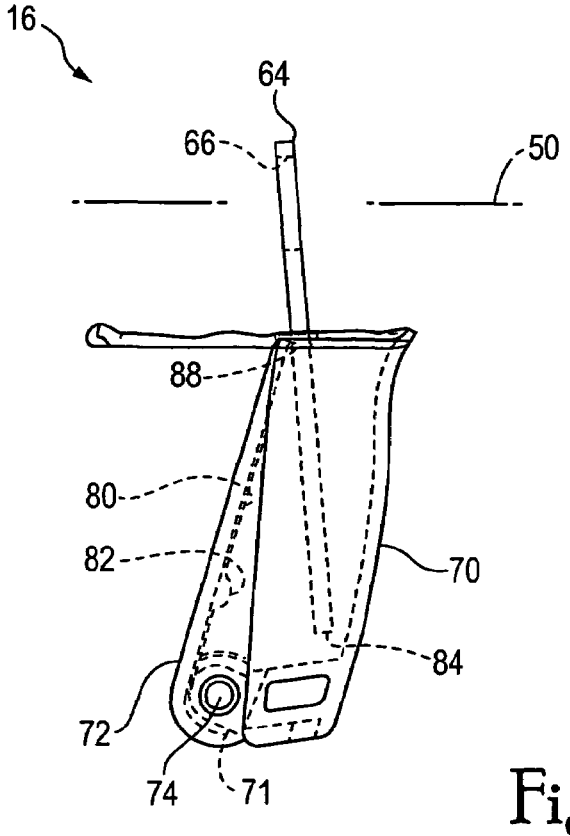

As the trigger 72 is pulled further, as seen in FIG. 5, the trigger 72 pivots further about pin 74 and the contact point between the trigger 72 and the drive lever 64 shifts from the initial contact point 82 to the final contact point 88, which is substantially closer to the bar 12. Thus, the mechanical advantage is reduced to a low mechanical advantage. This is because the force applied by the user to the trigger 72 is now being applied at contact point 88, which is very close to the bar 12. However, since the trigger 72 is pivoted at the end of handle 70 that is remote from the bar 12, the final contact point 88 moves a great distance compared to the movement of the initial contact point 82. Therefore, although the mechanical advantage shown in FIG. 5 using final contact point 88 is low, the amount that the bar 12 travels to toward the rear 86 of the housing 60 increases. FIG. 3 shows the positional movement change of the drive lever 64 from the position of FIG. 4 (shown with drive lever 64' (prime) in dashed lines) to the position of FIG. 5 (shown with the drive lever 64" (double prime) in dashed lines).

Therefore, if, for example, the fixed jaw 16 is not in contact with the member 18 a user can quickly and easily pull the trigger 72 to its fullest extent and rapidly repeat the full trigger pulls to quickly and easily move the bar 12 toward the rear 86 of housing 60 since the final contact point 82 is employed. Then, when, for example, the jaws 14 and 16 are in contact with the member 18 and it is desired to clamp the member 16 with a large force requiring little movement of the bar 12, the initial contact point 82 will be employed since only slight movement of the bar 12 by the drive lever 64 will be possible and a high mechanical advantage will be produced making it relatively easier for the use to apply a higher clamping force against the bar 12 and the member 18.

Although, the illustrated embodiment only shows two contact points 82 and 88, the contact surface 80 of trigger 72 may be designed so that there are any number of contact points. For example, the contact surface 80 could provide an entirely gradual change of position for the contact point between the trigger 72 and the drive lever 64. Thus, the contact point could gradually move up the drive lever 64 as the trigger 72 is pulled toward the housing 60.

When it is desired to release the clamping force and the bar 12, fixed jaw 16 also has a breaking lever 90 that permits the bar 12 to pass therethrough. The braking lever 90 is pivoted within the housing 60 within a groove 92 and is biased by a resilient element, such as a spring 94. The spring 94 biases the braking lever 90 against the bar 12 to lock the housing 60 and the fixed jaw 16 in a selected position on the bar 12. So that when the trigger 72 is pulled and the bar 12 moves toward the rear 86 of housing 60, the breaking lever 90 is biased by spring 94 to permit movement in that direction but to prohibit movement in the opposite direction. The principles of locking are similar to those of the breaking lever 90 of the moving jaw 14 and of the drive lever 64 of the fixed jaw 16. When it is desired to move the bar 12 through the fixed jaw 16 toward the clamping face 62, a release button 96 is used to move the bottom of breaking lever 90 toward the rear 86 of housing 60 and release the bar 12 to move in the forward direction. The release button 96 is pivoted to the housing at pivot and has a mid-portion 99 that captures the bottom of breaking lever 90 to move the lever 90 when the release button 96 is pivoted.

Figure 6:
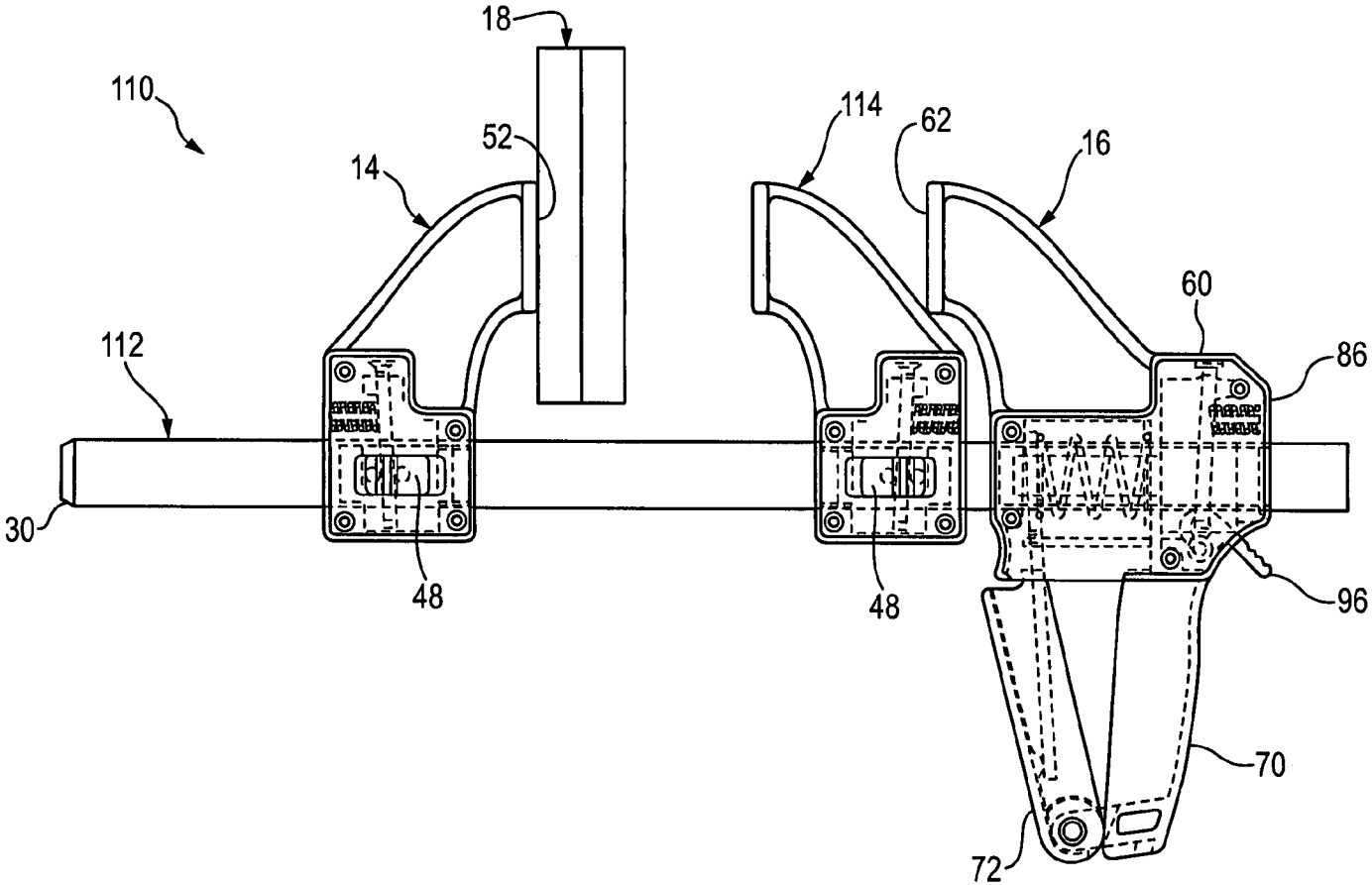
FIG. 6 illustrates an adjustable clamp in accordance with another illustrated embodiment of the present invention.
Figure 7:
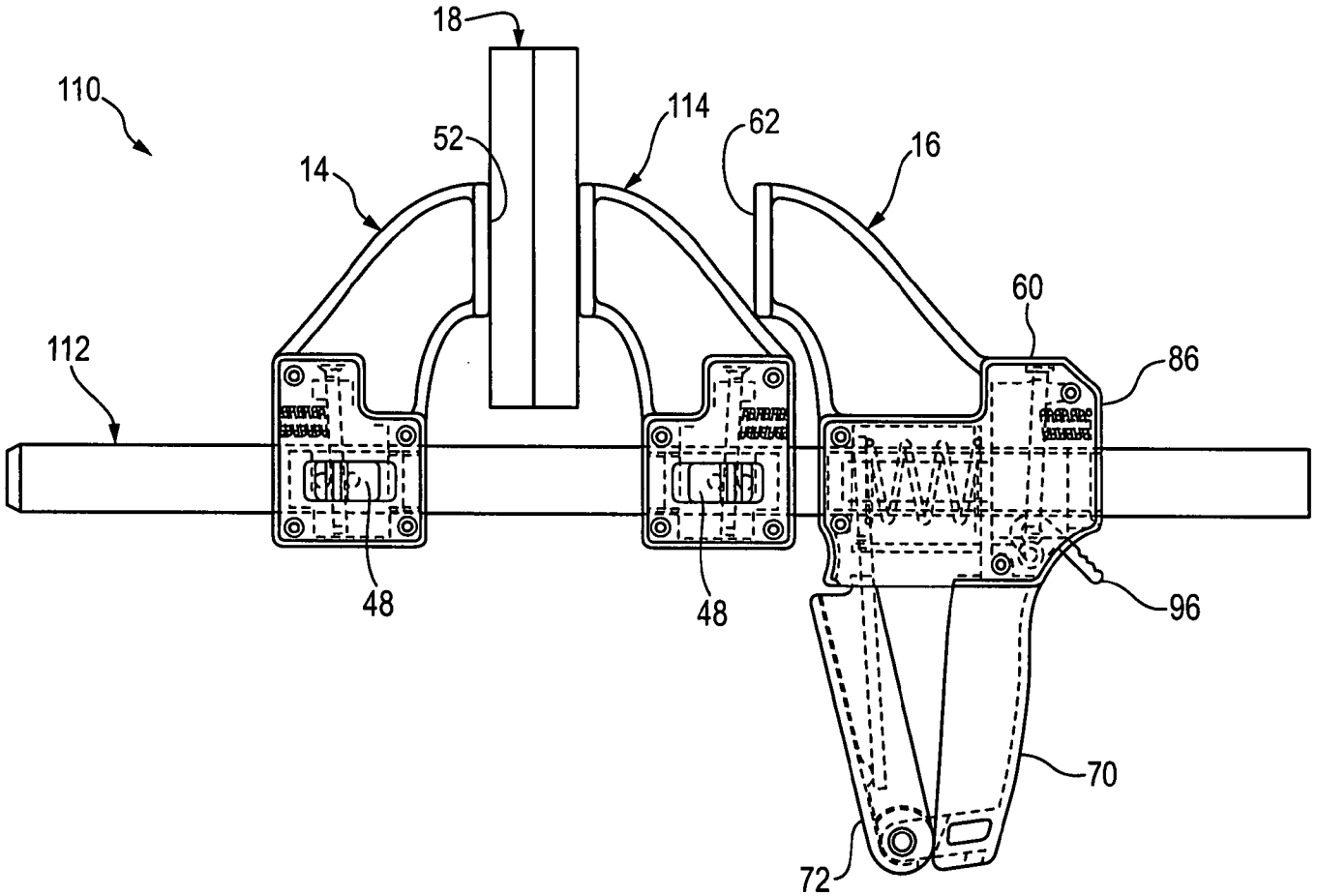
FIG. 7 illustrates the clamp of FIG. 6 clamping the member to be clamped.
Figure 8:
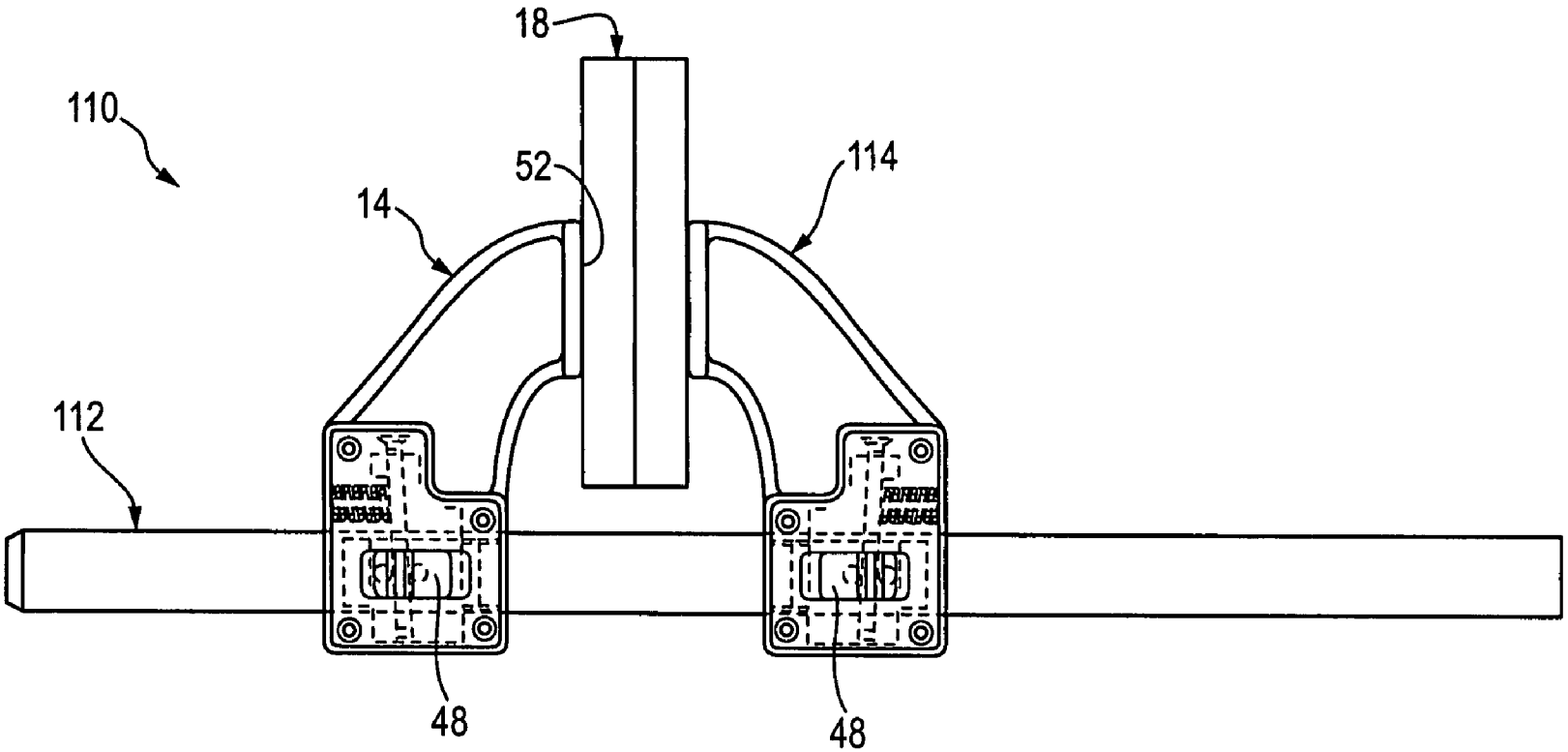
FIG. 8 illustrates the clamp of FIG. 8 with the motor unit removed after the member is clamped.

FIGS. 6–8 show another embodiment of the invention, wherein two moving jaws 14 and 114 are used to clamp member 18. FIG. 6 shows an adjustable clamp 110 having a bar 112, a first moving jaw 14, a second moving jaw 114, and a fixed jaw 16. Clamp 110 is substantially identical to clamp 10 described above, except for the inclusion of a second moving jaw 114. Also, moving jaw 114 is substantially identical to moving jaw 14, except that moving jaw 114 is oriented in an opposite direction and, thus, may move freely toward moving jaw 14, but it will only move away from moving jaw 14 if the release button 48 is used. Bar 112 is substantially identical to bar 12 except that bar 112 does not have a stop 32.

As can be seen in FIG. 6, the moving jaw 114 is positioned between the fixed jaw 16 and the moving jaw 14 so that when the fixed jaw 16 is actuated to pull the bar 112 through fixed jaw 16 toward the rear 86 of housing 60, the moving jaw 14 will clamp the member 18 along with second moving jaw 114 instead of fixed jaw 16 as seen in FIG. 7. Then, once the first and second moving jaws 14 and 114 clamp member 18, the fixed jaw 16 can be removed from the bar 112 while the clamp on member 18 is maintained and be used in other adjustable clamps, such as in clamps similar to clamp 10 or in clamps similar to clamp 110. Fixed jaw 16 can be removed from bar 12 by pushing the release button 96 and pulling the fixed jaw 16 away from the moving jaw 114 and off the bar 12. When it is desired to release the clamping of member 18, the release buttons 48 are activated.

Figure 9:
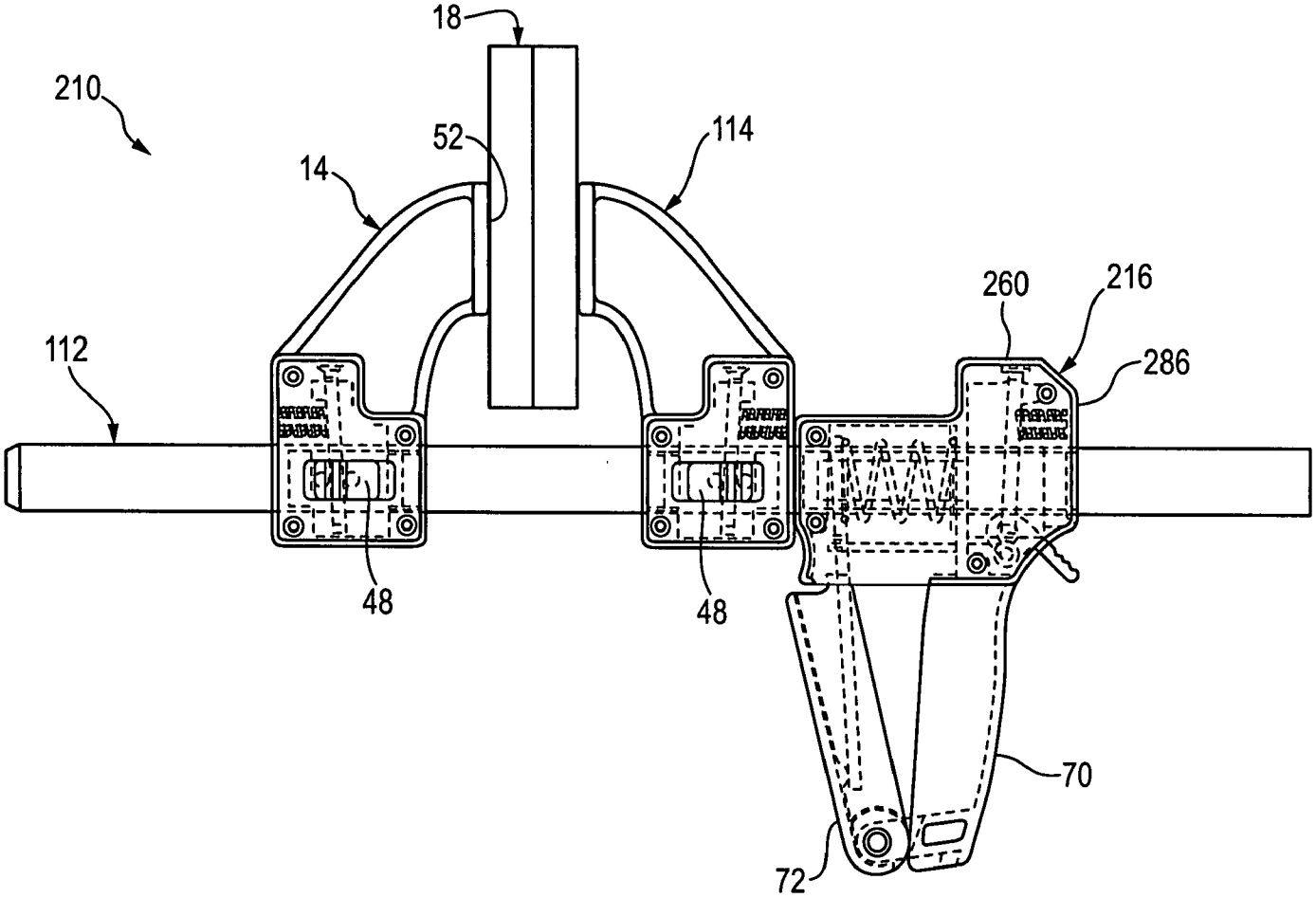
FIG. 9 illustrates an adjustable clamp similar to that shown in FIG. 7, but with motor unit without a clamping surface, in accordance with yet another embodiment of the invention.

FIG. 9 shows yet another embodiment of the invention. FIG. 9 shows an adjustable clamp 210 that is substantially identical to clamp 110 disclosed above in FIGS. 6–8 except that clamp 210 does not use fixed jaw 16. Instead, clamp 210 uses a mechanical motor unit 216 that does not have a clamping surface. That is, mechanical motor unit 216 is substantially identical to fixed jaw 16 except that mechanical motor unit 216 does not have the clamping surface 62 that projects from the housing 60 of fixed jaw 16. Instead, the housing 260 has no projections. The mechanical motor unit 216 may be employed as a force applying mechanism for moving jaws such as 14 and 114 and can be use to clamp numerous devices that are being clamped with, for example, two moving jaws as seen in FIG. 8.

Additionally, the ability to remove the fixed jaw 16 or the motor unit 216 in addition to the moving jaws 14 and 114 permit different length bars to be employed with the same clamping devices, such as, 14, 114, and 16. Thus, a user can have one set of clamping devices (jaws/motor units), such as 14 and 16 or 14, 114, and 16, and bars of different lengths for different applications. This concept of using different length bars is equally applicable in all of the embodiments disclosed herein including those previously disclosed herein.

The foregoing embodiments have been provided to illustrate the structural and functional principles of the present invention, and are not intended to be limiting. To the contrary, the present invention is intended to encompass all modifications, alterations, and substitutions within the scope of the appended claims.

What is claimed is:

1. A method of using a bar clamp, comprising:

positioning first and second moving jaws on a first bar clamp, each of the first and second moving jaws being selectively positionable on a first bar;

positioning a mechanical motor unit on the first bar;

positioning the first and second moving jaws of the first bar clamp on opposite sides of a first member to be clamped; and activating the mechanical motor to move the first bar and force the first moving jaw toward the second moving jaw until both the first and second moving jaws securely clamp the first member to be clamped between the first and second moving jaws.

2. A method according to claim 1, wherein the positioning of the first and second moving jaws on the first bar clamp occurs before the mechanical motor is positioned on the first bar clamp.

3. A method according to claim 1, wherein the positioning of the first and second moveable jaws of the first bar clamp on opposite sides of the member to be clamped includes positioning the first and second moveable jaws on opposite sides of a stationary member to be clamped.

4. A method according to claim 1, wherein activating the mechanical motor includes pulling a trigger on the motor unit.

5. A method according to claim 1, further comprising:

removing the mechanical motor from the first bar after the first member to be clamped is clamped between the first and second moving jaws and before the first and second moving jaws are released from their respective clamped positions against the first member.

6. A method according to claim 5, further comprising:

positioning the mechanical motor on a second bar.

7. A method according to claim 6, further comprising:

positioning a third moving jaw on the second bar.

8. A method according to claim 7, further comprising:

activating the mechanical motor to move the second bar and force the third moving jaw toward a mechanical motor jaw extending from the mechanical motor to until both the third moving jaw and the mechanical motor jaw securely clamp a second member to be clamped between the third moving clamp and the mechanical motor clamp.

9. A method of claim 1, wherein the second bar is a different length than the first bar.

10. A method of using a bar clamp, comprising:

positioning a first jaw on a first bar clamp, the first jaw being selectively securable on the first bar;

positioning a second jaw with a mechanical motor on the first bar, the second jaw having a main section structured and arranged to permit the first bar move the first jaw relative to the second jaw, a clamping face extending from the main section, a drive lever that is structured and arranged to couple the first bar, a handle extending from the main section, and a trigger pivoted to the handle at a position on the handle that is spaced from the first bar; and activating the mechanical motor to move the first bar and to force the first jaw toward the second jaw, the activating of the motor unit occurring by pulling a trigger towards the handle as the trigger pivots, the trigger contacting the drive lever at a movable contact point while the trigger is pulled, such that the contact point between the trigger and the drive lever changes along the length of the drive lever as the trigger pivots with respect to the handle so that when the pulling of the trigger begins and the trigger is at a position furthest from the handle, the contact point is remote from the first bar and the trigger provides a high mechanical advantage to the drive lever, and as the pulling of the trigger continues and the trigger is pulled closer to the housing the contact point moves to a point on the drive lever that is closer to the first bar so that the trigger provides a lower mechanical advantage and moves the bar at a greater rate than when the contact point is spaced from the first bar.

11. A method of claim 10, further comprising:

removing the first jaw and the second jaw from the first bar; and positioning the first jaw and the second jaw on a second bar, which has a length that is different than the length of the first bar.

* * * * *